US009835320B2

(12) United States Patent
Zhang et al.

(10) Patent No.: US 9,835,320 B2
(45) Date of Patent: Dec. 5, 2017

(54) POWER SUPPLY SYSTEM FOR SHELF TRACK LIGHTING DEVICE

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Chengke Zhang, Zhejiang (CN); Zhaoyong Zheng, Zhejiang (CN); Zhiming Wang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/380,700

(22) Filed: Dec. 15, 2016

(65) Prior Publication Data

US 2017/0191649 A1 Jul. 6, 2017

(30) Foreign Application Priority Data

Dec. 31, 2015 (CN) ..... 2015 1 1029419

(51) Int. Cl.

| | |
|---|---|
| ***H01R 25/14*** | (2006.01) |
| ***F21V 23/06*** | (2006.01) |
| ***F21S 4/28*** | (2016.01) |
| ***F21V 17/12*** | (2006.01) |
| *F21Y 103/10* | (2016.01) |
| *F21Y 115/10* | (2016.01) |

(52) U.S. Cl.

CPC ..... *F21V 23/06* (2013.01); *F21S 4/28* (2016.01); *F21V 17/12* (2013.01); *H01R 25/142* (2013.01); *F21Y 2103/10* (2016.08); *F21Y 2115/10* (2016.08); *H01R 25/14* (2013.01)

(58) Field of Classification Search

CPC . F21V 17/12; F21V 23/06; F21S 4/28; H01R 25/142; H01R 25/14

USPC ..... 439/96, 110, 111, 112, 121, 347, 725, 439/856, 4

See application file for complete search history.

(56) References Cited

U.S. PATENT DOCUMENTS

| | | | | |
|---|---|---|---|---|
| 4,729,742 A * | 3/1988 | Onishi | ..... | H01R 25/14 439/208 |
| 5,334,037 A * | 8/1994 | Gabrius | ..... | H01R 25/142 439/118 |
| 6,884,095 B1 * | 4/2005 | Tsai | ..... | H01R 25/142 439/118 |

* cited by examiner

*Primary Examiner* — Renee Luebke
*Assistant Examiner* — Paul Baillargeon
(74) *Attorney, Agent, or Firm* — Wang Law Firm, Inc.

(57) ABSTRACT

A power supply system for shelf track lighting device includes a track, and a jointer. The track includes a U-shaped slot, two grooves, and two conductive posts. The jointer includes a bottom cover, an upper cover, and two elastic chips. The upper cover includes a T-shaped supporting cover. The two elastic chips are sandwiched between the T-shaped supporting cover and the bottom cover. The elastic chip includes an arm, a supporting end, an arc-shaped bend portion, and three right-angle-shaped bend portion. The arc-shaped bend portion is near the arm and the arm holds out of the T-shaped supporting cover and abuts against the conductive post. The arm is retracted into the T-shaped supporting cover under the resilient deformation force of the three right-angle-shaped bend portions, thereby tightly connecting the elastic chip to the conductive post is achieved, and further, power can be supplied to the strip LED lamp.

7 Claims, 4 Drawing Sheets

POWER SUPPLY SYSTEM FOR SHELF TRACK LIGHTING DEVICE

RELATED APPLICATION

This present application claims benefit of the Chinese Application, CN201511029419.0, filed on Dec. 31, 2015.

BACKGROUND

1. Technical Field

The present application relates to lighting equipments, and more particularly to a power supply system for shelf track lighting device.

2. Description of the Related Art

Light emitting diode (LED) is growing in popularity due to decreasing costs and long life compared to incandescent lighting and fluorescent lighting. Recently, a number of LED lighting apparatuses have been designed to replace the halogen apparatus, as well as other traditional incandescent or fluorescence lighting apparatuses. In some places such as exhibition halls, jewelry stores, museums, supermarkets, and some home lighting, such as large villas, will use a lot of strip LED lamps. As the LED lamps require a specific power supply, and cannot use directly the 220-volt mains power supply. Therefore, these strip LED lamp need to electrically connect an additional and specific drive power for supplying power therefor.

In actual application of shelf, if these extra and specific powers are directly connected to each strip LED lamp, it is not only trouble for the installation of LED strip lights trouble, and not beautiful.

Therefore, it is necessary to provide a power supply system for shelf track light device which is used to supply power for the strip LED light lamp.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
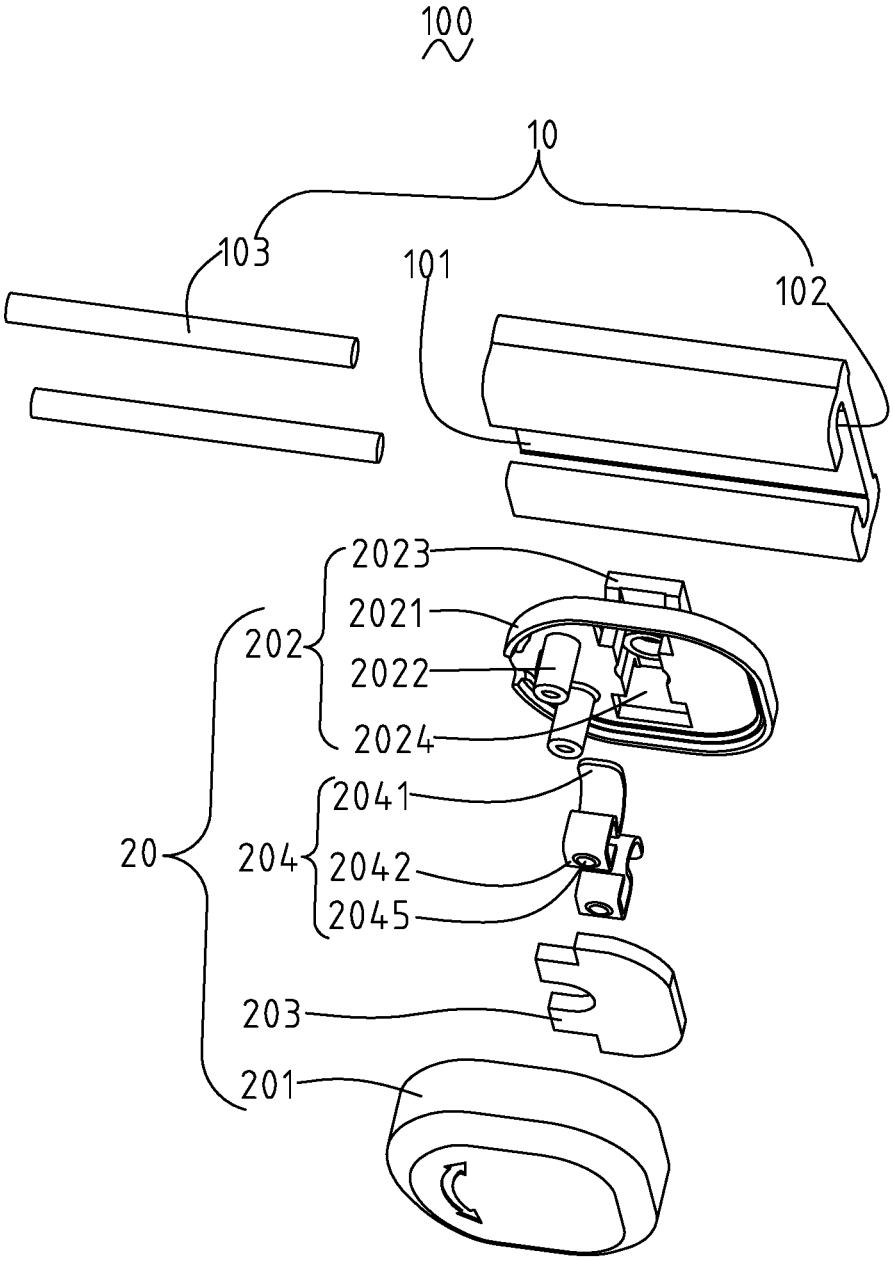
FIG. 1 is an exploded schematic view of a power supply system for shelf track lighting device according to an embodiment.
Figure 2:
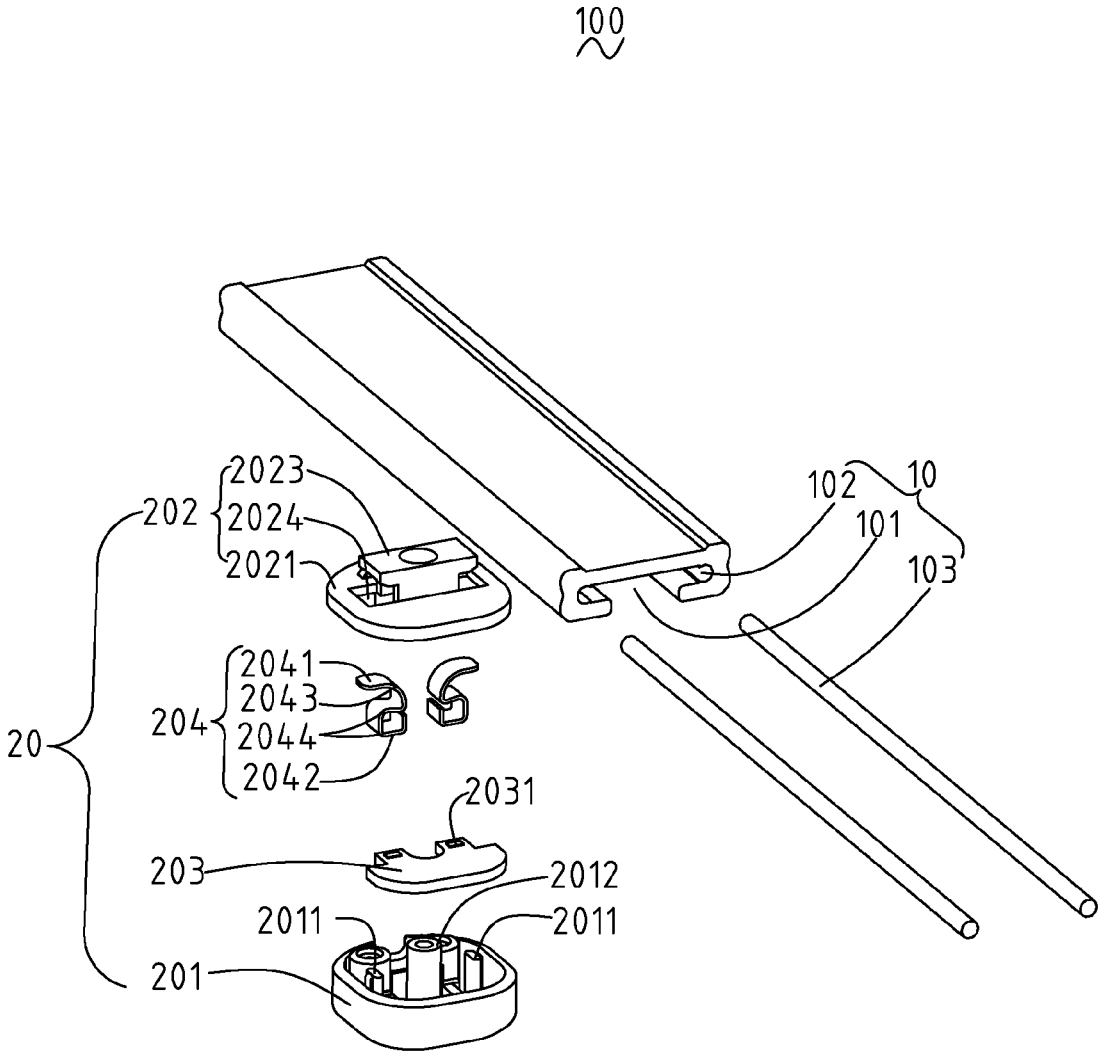
FIG. 2 is an exploded schematic view of another aspect of the power supply system for shelf track lighting device of FIG. 1.
Figure 3:
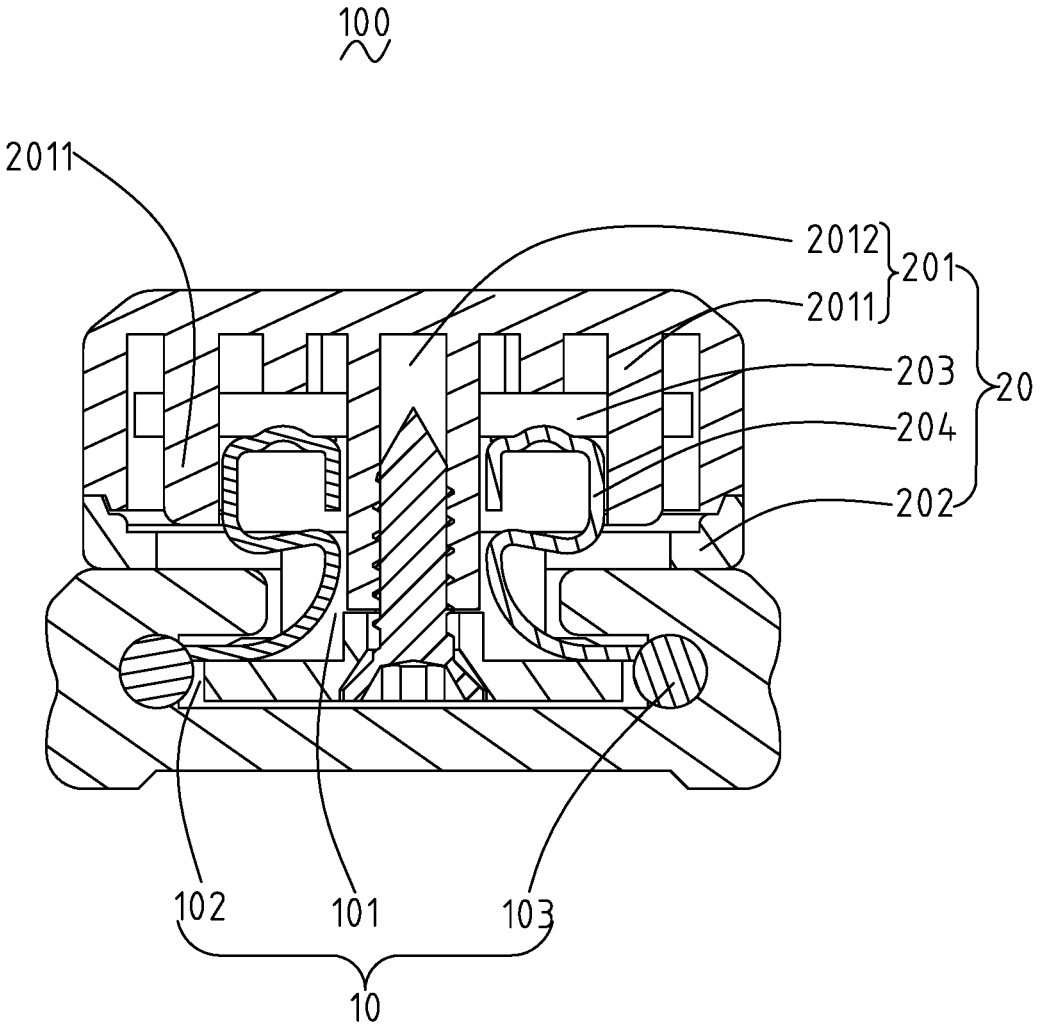
FIG. 3 is a cross section view of the power supply system for shelf track lighting device of FIG. 1.

Referring to FIG. 1-FIG. 3, a power supply system 100 for shelf track lighting device according to an embodiment are shown. The power supply system 100 for shelf track light device includes a track 10, and a jointer 20 slidably disposed on the track 10. It is of course understood that the power supply system 100 also includes other functional modules, such as a mounting assembly for mounting the track 10, a plug-in assembly for electrically connecting a strip LED lamp with the power supply system 100, and the like. It is well known for a person skilled in the art and no need to describe in detail.

The track 10 includes a U-shaped slot 101, two grooves 102 respectively arranged on the two side walls of the U-shaped slot 101, and two conductive posts 103 respectively received in the two grooves 102. The U-shaped slot 101 may be made of an insulating material such as plastic, resin or the like to avoid electrical leakage of the U-shaped slot 101 from the conductive post 103, thereby resulting in a safety hazard. The length of the U-shaped groove 101 may be determined in accordance with actual application, such as the height or length of a shelf. The grooves 102 are respectively formed in the two inner side walls of the U-shaped groove 101 for accommodating the two conductive posts 103. The depth of the groove 102 should be greater than the diameter of the conductive post 103 to leave a space to engaging the jointer 20. The conductive post 103 is made of a conductive material, which is fixed in the groove 102 by means of bonding, riveting, or the like. In the present embodiment, the conductive post 103 is made of copper, and its length may be equal to the length of the U-shaped slot 101.

The jointer 20 includes a bottom cover 201, an upper cover 202 fastened onto the bottom cover 201, a circuit board 203 mounted on the bottom cover 201, and two elastic chips 204 sandwiched between the circuit board 203 and the upper cover 202. It can be understood that since the circuit board 203 is mounted on the bottom cover 201, the elastic chips 204 is also sandwiched between the bottom cover 201 and the upper cover 202.

The bottom cover 201 is made of an insulating material such as plastic to avoid electric leakage and is formed into a frame shape to receive the circuit board 203. The bottom cover 201 includes two positioning pegs 2011 spaced from each other and a screw fixing post 2012 arranged between the two positioning pegs 2011. The two elastic chips 201 are respectively clamped between the two positioning pegs 2011 and the screw fixing post 2012. In addition, the bottom cover 201 further includes two positioning holes 2013. The two positioning holes 2013 are configured for positioning the upper cover 202 during mounting the upper cover 202 so as to same installation time.

The upper cover 202 is also made of an insulating material and includes a body 2021, two positioning pins 2022 disposed on the one side of the body 2021, a T-shaped supporting cover 2023 disposed on the another side of the body 2021, and two through holes 2024 provided on both sides of the T-shaped supporting cover 2023. The two positioning pins 2022 are arranged on opposite side of the T-shaped supporting cover 2023 with respect to the body 2021 and configured for engagement with the positioning holes 2013 respectively. When the upper cover 202 is engaged with the bottom cover 201, the two positioning pins 2022 are inserted into the two positioning holes 2013 respectively, thereby positioning the upper cover 202 and bottom cover 201 relative to each other. A screw hole 2025 for engaging with the screw fixing post 2012 is formed in the connecting post of the T-shaped supporting cover 2023 and the body 2021 so as that the upper cover 202 and the bottom cover 201 can be fixed together by screws (not shown). The two through holes 2024 are configured to insert the two elastic chips 204 respectively, and one end of each of the two elastic chips 204 held out of the through hole 2024 so as to electrically connected to the conductive post 103.

The circuit board 203 is housed in a frame of the bottom cover 201 and is provided with circuits and electronic devices for realizing functions such as electric conduction, or the like. In the present embodiment, the circuit board 203 includes two contact pads 2031 electrically connected to the two elastic chips 204 respectively so as to realize the function of electrical connection. It will be appreciated that the circuit board 203 is electrically connected to a plug-in assembly to electrically connect with the strip LED lamp.

Figure 4:
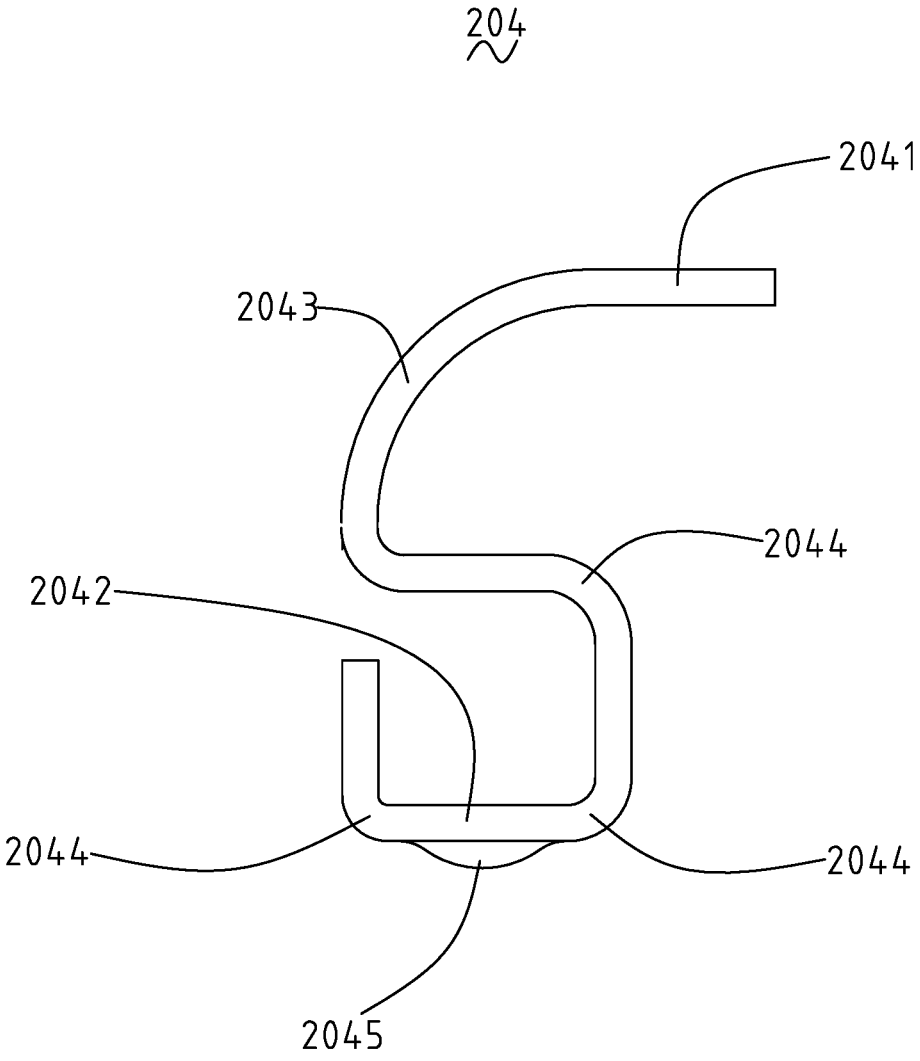
FIG. 4 is a schematic view of an elastic chip of the power supply system for shelf track lighting device of FIG. 1.

Referring to FIG. 4 together, the two elastic chips 204 are sandwiched between the positioning pegs 2011 and the screw fixing post 2012 and abuts between the circuit board 203 and the T-shaped supporting cover 2023 of the upper cover 202. In addition, one end of each of the two elastic chips 204 held out of the through holes 2024 of the upper cover 202 in order to electrically connect with the conductive post 103. As shown in FIG. 4, each of the two elastic chips 204 is of an S-shaped configuration and includes an arm 2041, a supporting end 2042, an arc-shaped bend portion 2043 and three right-angle-shaped bend portions 2044. The arc-shaped bend portion 2043 is arranged between the arm 2041 and one of the right-angle-shaped bend portions 2044. The arm 2041 abuts against the T-shaped supporting cover 2023 and a free end of the arm 2041 protrudes out of the T-shaped supporting cover 2023 in order to electrically connect to the conductive post 103. The supporting end 2042 contact against the contact pad 2031 of the circuit board 203 and further includes a protrusion 2045 on the side of the contact pad 2031 so as to ensure reliable electrical connection between the supporting end and the contact pad 2031 and avoid virtual connection. In the normal state of the elastic chip 204, the maximum distance between the two arms 2041 of the two elastic chips 204 is greater than the minimum distance of the two conductive posts 103. And, in compressed state of the elastic chip 204, a maximum distance of the two arms 2041 is equal to a minimum distance of the two conductive posts 103.

In application, a user inserts the T-shaped supporting cover 2023 of the jointer 20 into the U-shaped slot 101 of the track 10 and then rotates the T-shaped supporting cover 2023 of the jointer at 90 degrees so as that the arm 2041 of the elastic chip 204 abuts against the conductive post 103. As a result, the jointer 20 is clamped into the track 10 and also can slide along the U-shaped slot 101 of the track 10 to engage with the strip LED lamp in different positions of the track 10. During the course of the rotation of the jointer 20, a portion of the arm 2041, which protrudes out of the T-shaped supporting cover 2023, is pressed by the conductive post 103, and a pressure is transmitted to the arm 2041 and the right-angle-shaped bend portion 2044. In result, the right-angle-shaped bend portion 2044 will be elastically deformed. Since the right-angle-shaped bend portion 2044 has a right angle, the pressure cannot be transmitted into other parts and the three right-angle-shaped bend portions 2044 will deform in the direction of the bottom cover 201. As a result, the arm is retracted into the T-shaped supporting cover 2023 while it is pushed against the conductive post 103 under the resilient deformation force of the three right-angle-shaped bend portions 2044. Therefore, the purpose of tightly connecting the elastic chip 204 to the conductive post 13 is achieved, and further, power can be supplied to the strip LED lamp.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A power supply system for shelf track lighting device, comprising:

a track, the track comprising a U-shaped slot, two grooves respectively arranged on the two side walls of the U-shaped slot, and two conductive posts respectively received in the two grooves;

a jointer slidably disposed on the track, the jointer comprising a bottom cover, an upper cover fastened onto the bottom cover, and two elastic chips interposed between the bottom cover and the upper cover, the upper cover comprising a T-shaped supporting cover extending outwardly therefrom, the two elastic chips being clamped between the T-shaped supporting cover and the bottom cover, each of the two elastic chips being of a S-shaped configuration and comprising an arm, a supporting end, an arc-shaped bend portion, and three right-angle-shaped bend portions, the arc-shaped bend portion being arranged between the arm and one of the right-angle-shaped bend portions, the arm extending out of the T-shaped supporting cover and electrically connecting to one of the conductive posts.

2. The power supply system for shelf track lighting device as claimed in claim 1, wherein a maximum diameter of the conductive posts is less than a depth of the grooves.

3. The power supply system for shelf track lighting device as claimed in claim 1, further comprising a circuit board disposed in the bottom cover, the circuit board comprises two contact pads electrically connected to the two elastic chips respectively.

4. The power supply system for shelf track lighting device as claimed in claim 3, wherein each elastic chip clamps between the T-shaped supporting cover and the contact pads.

5. The power supply system for shelf track lighting device as claimed in claim 3, wherein the supporting end further comprises a protrusion extending toward said contact tab, the protrusion abuts against one of the contact pads.

6. The power supply system for shelf track lighting device as claimed in claim 1, wherein in a normal state of the elastic chips, a maximum distance between the two arms of the two elastic chips is greater than a minimum distance between the two conductive posts.

7. The power supply system for shelf track lighting device as claimed in claim 1, wherein in a compressed state of the elastic chips, a maximum distance of the two arms is equal to a minimum distance between the two conductive posts.

* * * * *